US011371112B2

(12) United States Patent
Jin et al.

(10) Patent No.: US 11,371,112 B2
(45) Date of Patent: Jun. 28, 2022

(54) COLD-ROLLED LOW-DENSITY STEEL SHEET HAVING EXCELLENT PHOSPHORABILITY, AND MANUFACTURING METHOD THEREFOR

(71) Applicant: BAOSHAN IRON & STEEL CO., LTD., Shanghai (CN)

(72) Inventors: Xinyan Jin, Shanghai (CN); Qi Yang, Shanghai (CN); Yanliang Zhao, Shanghai (CN); Li Wang, Shanghai (CN)

(73) Assignee: BAOSHAN IRON & STEEL CO., LTD., Shanghai (CN)

( * ) Notice: Subject to any disclaimer, the term of this patent is extended or adjusted under 35 U.S.C. 154(b) by 719 days.

(21) Appl. No.: 16/304,947

(22) PCT Filed: May 26, 2017

(86) PCT No.: PCT/CN2017/086174

§ 371 (c)(1),
(2) Date: Nov. 27, 2018

(87) PCT Pub. No.: WO2018/001019

PCT Pub. Date: Jan. 4, 2018

(65) Prior Publication Data

US 2021/0222266 A1 Jul. 22, 2021

(30) Foreign Application Priority Data

Jun. 28, 2016 (CN) ..... 201610486477.4

(51) Int. Cl.
*C21D 9/46* (2006.01)
*C21D 6/00* (2006.01)
(Continued)

(52) U.S. Cl.
CPC ..... *C21D 9/46* (2013.01); *C21D 6/005* (2013.01); *C21D 8/0205* (2013.01);
(Continued)

(58) Field of Classification Search
CPC ..... C21D 9/46; C21D 6/005; C21D 8/0205; C21D 8/0226; C21D 8/0236;
(Continued)

(56) References Cited

U.S. PATENT DOCUMENTS

2014/0363697 A1* 12/2014 Kim ..... C22C 38/06 205/152
2016/0145706 A1 5/2016 Chung et al.
2016/0194739 A1* 7/2016 Del Frate ..... B32B 15/043 148/277

FOREIGN PATENT DOCUMENTS

CN 103827338 5/2014
CN 104674109 6/2015
(Continued)

OTHER PUBLICATIONS

International Search Report and Written Opinion for PCT/CN2017/086174 dated Aug. 31, 2017.
(Continued)

*Primary Examiner* — Christopher S Kessler
*Assistant Examiner* — Andrew M Cheung
(74) *Attorney, Agent, or Firm* — Lei Fang; Smith Tempel Blaha LLC

(57) ABSTRACT

A cold-rolled low-density steel sheet having excellent phosphorability is provided. An iron particle layer is disposed on the surface of the cold-rolled low-density steel sheet, and dispersed iron particles exist in the iron particle layer. The cold-rolled low-density steel sheet comprises 3.0% to 7.0% of element Al by mass percentage.

20 Claims, 5 Drawing Sheets

(51) Int. Cl.

| | |
|---|---|
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |

(52) U.S. Cl.
CPC ..... *C21D 8/0226* (2013.01); *C21D 8/0236* (2013.01); *C21D 8/0263* (2013.01); *C22C 38/001* (2013.01); *C22C 38/002* (2013.01); *C22C 38/02* (2013.01); *C22C 38/04* (2013.01); *C22C 38/06* (2013.01); *C21D 2211/001* (2013.01); *C21D 2211/005* (2013.01)

(58) Field of Classification Search
CPC ..... C21D 8/0263; C21D 2211/001; C21D 2211/005; C22C 38/001; C22C 38/002; C22C 38/02; C22C 38/04; C22C 38/06
See application file for complete search history.

(56) References Cited

FOREIGN PATENT DOCUMENTS

| | | |
|---|---|---|
| CN | 104928456 | 9/2015 |
| CN | 104928568 | 9/2015 |
| CN | 104928569 | 9/2015 |
| CN | 105358719 | 2/2016 |
| CN | 106011652 | 10/2016 |
| JP | S6118762 | 1/1986 |
| JP | H07144750 | 6/1995 |
| JP | 2006045615 | 2/2006 |
| JP | 2008056993 | 3/2008 |
| JP | 2009287114 | 12/2009 |
| JP | 2013237923 | 11/2013 |
| JP | 2014501852 | 1/2014 |
| JP | 2015054990 | 4/2015 |
| JP | 2017508068 | 3/2017 |
| KR | 20160027105 | 3/2016 |
| WO | 2013034317 | 3/2013 |
| WO | 2015001367 | 1/2015 |
| WO | 20150180463 | 12/2015 |

OTHER PUBLICATIONS

European Search Report dated Jan. 27, 2020 for European Patent Application No. 17819016.1.
1st Office Action dated Jan. 7, 2020 for Japanese Patent Application No. 2019-514171.
Decision for Refusal dated Sep. 1, 2020 for Japanese Patent Application No. 2019-514171.
1st Office Action dated Dec. 2, 2019 Korean Patent Application No. 20187031774.
2nd Office Action dated May 11, 2020 Korean Patent Application No. 20187031774.
Notice of Allowance dated Aug. 25, 2020 Korean Patent Application No. 20187031774.

* cited by examiner

COLD-ROLLED LOW-DENSITY STEEL SHEET HAVING EXCELLENT PHOSPHORABILITY, AND MANUFACTURING METHOD THEREFOR

CROSS-REFERENCE TO RELATED APPLICATIONS

This application is a 371 U.S. National Phase of PCT International Application No. PCT/CN2017/086174 filed on May 26, 2017, which claims benefit and priority to Chinese patent application no. 201610486477.4, filed on Jun. 28, 2016. Both of the above-referenced applications are incorporated by reference herein in their entireties.

TECHNICAL FIELD

The present invention relates to a cold-rolled steel sheet and manufacturing method therefor, and more particularly to a cold-rolled steel sheet having excellent phosphorability and manufacturing method therefor.

BACKGROUND ART

With the increasing requirements of environmental regulations and energy conservation and consumption reduction, light weight becomes one of the development directions of automobile. From material perspective, the ways to achieve lightweight vehicles are as follows: using light alloys such as aluminum and magnesium instead of steel; using high-strength steel instead of traditional low-strength steel to achieve a reduction of the material thickness; increasing the specific strength of steel by reducing the density of steel, i.e. developing low-density steel.

In the prior art, the reduction of material density was achieved by adding a certain amount of aluminum to the steel since aluminum has a much lower density than steel.

For example, a Chinese patent entitled "High strength interstitial free low density steel and method for producing said steel" (publication number: CN104220609A, publication date: Dec. 17, 2014) discloses a high strength interstitial free low density steel and manufacturing method therefor, wherein the steel has an Al content of 6~9% in order to reduce density.

Moreover, a Chinese patent entitled "Low density steel with good stamping capability" (publication number: CN101755057A, publication date: Jun. 23, 2010) discloses a hot-rolled ferrite steel sheet, wherein the content of Al is 6%≤Al≤10%.

However, when phosphating a steel having a high Al content, the coverage fraction of phosphating crystals is low, which does not meet the requirements of the automotive user for painting. After oil removal and derusting, materials used in automotive parts are usually phosphated to form a phosphate film on the metal surface. The normal phosphate film is porous and uniform. The coating material penetrates into the pores, which has the effect of increasing the adhesion of the coating, as well as effects of resisting corrosiveness of electrophoretic paint during electrophoresis and enhancing the electrophoresis effect. Therefore, the phosphate film is a good underlayer which is indispensable for the coating, and the coating quality cannot be ensured when the phosphating treatment is not performed or the phosphating effect is not good.

Since high-strength steel adds many alloying elements, these alloying elements will be enriched on the surface of the annealed steel sheet to form an oxide film, which is not conducive to the uniform reaction of the phosphating process, and is liable to cause defects such as low phosphating coverage, coarse and/or loose phosphating crystals, which does not meet the requirements of automobile manufacturing. Poor phosphorability of high-strength steel sheet is also a common problem in automobile manufacturing.

In order to obtain excellent phosphorability of high-strength steel, a method is to control the content of alloy components. However, limiting the content of alloy components will affect performances of the material.

In addition to composition control, annealing process control is another method to improve the phosphorability of high-strength steel. However, the prior art has the following disadvantages: for example, the control of the annealing process cannot be applied to most continuous annealing lines; or the control of the process parameters during annealing production (e.g. control the dew point of atmosphere to −45° C. or lower) is difficult; or an increase in the annealing process steps leads to an increase in production costs.

When improving the phosphorability of high-strength steel, the prior art mainly deals with the adverse effects of the surface enrichment of elements Si and Mn on the phosphorability, while the mass percentage of element Al in such steel sheet is usually 1% or less.

SUMMARY OF THE INVENTION

One of the objects of the present invention is to provide a cold-rolled low-density steel sheet having excellent phosphorability, wherein the cold-rolled low-density steel sheet has a low density by controlling the mass percentage of element Al, and has a high strength and excellent phosphorability by controlling the surface oxidation of the steel sheet to form an iron particle layer. Thus, the present invention solves the technical problem in the prior art that high element Al content and excellent phosphorability are not compatible.

In order to achieve the above object, the present invention provides a cold-rolled low-density steel sheet having excellent phosphorability, wherein the surface of the cold-rolled low-density steel sheet has an iron particle layer, in which iron particles are dispersed; the cold-rolled low-density steel sheet contains 3.0% to 7.0% of element Al by mass percentage.

In the cold-rolled low-density steel sheet having excellent phosphorability according to the present invention, the design principle of element Al is that the element Al is a ferrite forming element. Since adding Al element can remarkably reduce the density of the steel sheet, the mass percentage of element Al in the present invention is not less than 3.0%. However, element Al having a mass percentage of more than 7.0% inhibits the formation of austenite. In addition, element Al significantly increases the stacking fault energy of austenite in steel. Therefore, element Al having a mass percentage of more than 7.0% inhibits that the residual austenite in the steel is induced to undergo martensitic transformation during deformation, making it difficult to obtain good strength and plasticity matching of the steel sheet. Therefore, the present invention defines the mass percentage of element Al to 3.0~7.0%. Moreover, the surface of the cold-rolled low-density steel sheet of the present invention has an iron particle layer, the iron particle layer can solve the problem of phosphating of low-density steel having high Al content.

Further, in the cold-rolled low-density steel sheet of the present invention, inner side of the iron particle layer has an internal oxidized layer adjacent to the iron particle layer, and the internal oxidized layer contains oxides of Al.

In the cold-rolled low-density steel sheet having excellent phosphorability of the present invention, the formation of external oxidation of $Al_2O_3$ is suppressed and converted into internal oxidation of the internal oxidized layer by controlling the dew point of the annealing atmosphere, and iron particles are formed on the surface of the steel sheet, thereby solving the problem of phosphating of cold-rolled high-strength low-density steel.

Further, in the cold-rolled low-density steel sheet of the present invention, the internal oxidized layer further contains oxides of Mn.

Further, in the cold-rolled low-density steel sheet of the present invention, the internal oxidized layer has a thickness of 0.2~10 μm.

In the cold-rolled low-density steel sheet having excellent phosphorability of the present invention, when the thickness of the internal oxidized layer is less than 0.2 μm, the external oxidation of element Al cannot be effectively suppressed; and when the thickness of the internal oxidized layer is more than 10 μm, the formation property of the sub-surface of steel sheet may be affected. Therefore, preferably, the thickness of the internal oxidized layer is controlled to 0.2~10 μm.

Further, in the cold-rolled low-density steel sheet of the present invention, the oxides of the internal oxidized layer exist in grain boundary and inside grain. The oxides in the internal oxidized layer are mainly Al oxides and Mn oxides, which are simultaneously distributed inside the grain and at the grain boundary of the internal oxidized layer.

Further, in the cold-rolled low-density steel sheet of the present invention, the thickness of the iron particle layer is less than the thickness of the internal oxidized layer.

Further, in the cold-rolled low-density steel sheet of the present invention, the iron particle layer has a thickness of 0.1~5 μm.

In the cold-rolled low-density steel sheet having excellent phosphorability of the present invention, when the thickness of the iron particle layer is less than 0.1 μm, the phosphorability is relatively poor; when the thickness of the iron particle layer is more than 5 μm, longer annealing holding time for forming the iron particle layer is needed. Therefore, preferably, the present invention defines that the thickness of the iron particle layer is 0.1~5 μm.

Further, preferably, the iron particle layer of the cold-rolled low-density steel sheet of the present invention has a thickness of 0.3~3 μm.

Further, in the cold-rolled low-density steel sheet of the present invention, the iron particles have a particle size of 0.1~5 μm.

In the cold-rolled low-density steel sheet having excellent phosphorability of the present invention, when the particle size of iron particles is less than 0.1 μm, the thickness and coverage area of the iron particles are less and phosphorability is relatively poor; when the particle diameter of iron particles is more than 5 μm, the iron particle layer becomes too thick. Therefore, preferably, the present invention defines that the iron particles have a particle size of 0.1~5 μm.

Further, in the cold-rolled low-density steel sheet of the present invention, the iron particles cover 30% or more of the surface area of steel sheet.

In the cold-rolled low-density steel sheet having excellent phosphorability of the present invention, when the iron particles cover less than 30% of the surface area of steel sheet, the surface area of the steel sheet not covered by the iron particles is too large, which may result in poor phosphorability at these portions. Therefore, preferably, the present invention defines that the iron particles cover 30% or more of the surface area of steel sheet.

Further, in the cold-rolled low-density steel sheet of the present invention, the maximum space between adjacent iron particles is no more than 10 times the average particle size of the iron particles.

In the above solution, if the maximum space between adjacent iron particles is more than 10 times the average particle size of the iron particles, the spacing between the iron particles may be unphosphorized when phosphating. Accordingly, preferably, the present invention defines that the maximum space between adjacent iron particles is no more than 10 times the average particle size of the iron particles.

Further, in the cold-rolled low-density steel sheet of the present invention, the microstructured of the steel sheet are ferrite and residual austenite.

Further, in the cold-rolled low-density steel sheet of the present invention, the phase ratio of the residual austenite is 6~30%.

Further, in the cold-rolled low-density steel sheet of the present invention, the mass percentage of element C in the residual austenite is not less than 0.8%.

In the cold-rolled low-density steel sheet having excellent phosphorability of the present invention, C is an important solid solution strengthening element that promotes austenite formation. In the low-density steel rich in element Al, when the mass percentage of C in the residual austenite is less than 0.8%, the content and mechanical stability of residual austenite are relatively low, resulting in a low strength and low ductility of the steel sheet. Therefore, the C content in the residual austenite of the cold-rolled low-density steel sheet having excellent phosphorability of the present invention is not less than 0.8%.

Further, the density of the cold-rolled low-density steel sheet of the present invention is less than 7500 kg/m$^3$, so that the cold-rolled low-density steel is low in density and light in weight, and is therefore suitable for the manufacture of automotive structural parts.

Further, mass percentages of chemical elements in the cold-rolled low-density steel sheet of the present invention are: C: 0.25~0.50%, Mn: 0.25~4.0%, Al: 3.0~7.0%, and the balance being Fe and other unavoidable impurities.

Wherein, the unavoidable impurities are mainly elements S, P and N, and can control that P≤0.02%, S≤0.01%, N≤0.01%.

The design principles of each chemical element in the cold-rolled low-density steel sheet are as follows:

C: C is an important solid solution strengthening element that promotes austenite formation. In the low-density steel rich in Al, when the mass percentage of C is less than 0.25%, the content and mechanical stability of residual austenite are relatively low, resulting in a low strength and low ductility of the steel sheet; when the mass percentage of C is more than 0.5%, lamellar carbides and carbide particles distributed at the ferrite grain boundaries are coarse, thereby reducing the rolling deformation ability of the steel sheet. Therefore, the present invention controls the C mass percentage to 0.25~0.50%.

Mn: Mn can increase the stability of austenite, reduce the critical cooling rate of steel during quenching and improve the hardenability of steel. Mn also can improve the work hardening properties of steel, thereby increasing the strength of the steel sheet. However, an excessively high Mn content causes Mn segregation in the slab and a significant band-like structure distribution in the hot-rolled plate, thereby reducing the ductility and bending properties of the steel sheet. Moreover, an excessively high Mn content tends to cause cracks in the hot-rolled plate during cold rolling deformation. Therefore, the present invention controls the mass percentage of Mn to 0.25~4.0%.

Element Al is a ferrite forming element. Since the density of the steel sheet can be remarkably reduced by adding element Al, the mass percentage of element Al in the present invention is not less than 3.0%. However, element Al having a mass percentage of more than 7.0% inhibits the formation of austenite. In addition, element Al may significantly increase the stacking fault energy of austenite in steel. Therefore, element Al having a mass percentage of more than 7.0% inhibits that the residual austenite in the steel is induced to undergo the martensitic transformation during deformation, making it difficult to obtain good strength and plasticity matching of the steel sheet. Therefore, the present invention defines the mass percentage of element Al to 3.0~7.0%.

P: P is a solid solution strengthening element. However, P increases the cold brittleness of the steel, reduces the plasticity of the steel and deteriorates the cold bending properties and the weldability. Therefore, the present invention defines the mass percentage of P to 0.02% or less.

S: S causes the steel to be hot brittle, reduces the ductility and toughness of the steel, deteriorates the weldability and reduces the corrosion resistance of the steel. Therefore, the present invention defines the mass percentage of S to 0.01% or less.

N: N and Al form AlN, and the columnar dendrites can be refined during solidification. However, when the N content is too high, the formed coarse AlN particles affect the ductility of the steel sheet. In addition, excess AlN reduces the thermoplasticity of the steel. Therefore, the present invention defines the mass percentage of N to 0.01% or less.

Further, the cold-rolled low-density steel sheet of the present invention may further contain at least one of elements Si, Ti, Nb, V, Cr, Mo, Ni, Cu, B, Zr and Ca.

Further, the cold-rolled low-density steel sheet of the present invention has an elongation of more than 25% and a tensile strength of more than 800 MPa.

Another object of the present invention is to provide a method for manufacturing the cold-rolled low-density steel sheet according to the present invention, by which any one of the above-described cold-rolled low-density steel sheets having excellent phosphorability can be produced.

In order to achieve the above object, the present invention provides a method for manufacturing the cold-rolled low-density steel sheet, comprising the steps of:

(1) smelting and casting;

(2) hot rolling;

(3) pickling;

(4) cold rolling;

(5) continuous annealing: heating to a soaking temperature of 750-950° C. and then holding 30-600 s, wherein dew point of annealing atmosphere is −15° C.~20° C.; then coiling the soaked strip steel after cooling.

In the present technical solution, the soaking temperature and the holding time of the continuous annealing in the step (5) are defined mainly for forming an iron particle layer on the surface of the steel sheet after continuous annealing. The reasons for controlling the soaking temperature to 750° C.~950° C. and the holding time to 30~600 s are as follows: at a soaking temperature below 750° C. or with a holding time less than 30 s, the martensite in steel substrate of cold-rolled low-density steel sheet does not sufficiently undergo austenite reverse phase transformation to form austenite particles, carbides in steel substrate of cold-rolled low-density steel sheet does not completely dissolve to form austenite particles, and strip-shaped high-temperature ferrite cannot sufficiently dynamic recrystallize and refined, so that the iron particle layer on the surface of the steel sheet after annealing would not be sufficiently formed and the phosphorability would be poor. When the soaking temperature is higher than 950° C. or the holding time is more than 600 s, austenite grains in the microstructures of the steel sheet substrate are coarsened after the soaking treatment, and the austenite stability in the steel is lowered, resulting in a decrease in the residual austenite content in the steel sheet substrate after annealing and a decrease in residual austenite stability. Consequently, the mechanical properties of the steel sheet after annealing deteriorate. When the soaking temperature is higher than 950° C. or the holding time is more than 600 s, the particle size of iron particles on the surface of the steel sheet after annealing becomes too large and the internal oxidized layer becomes too thick, which is detrimental to the forming properties of the surface of the steel sheet.

In addition, the formation of the iron particle layer in the present technical solution is closely related to the dew point of the annealing atmosphere defined in the technical solution. The formation of external oxidation of $Al_2O_3$ is suppressed and converted into internal oxidation of the internal oxidized layer by controlling the dew point of the annealing atmosphere in continuous annealing, so that the iron particles are formed on the surface of the steel sheet. Within the above dew point range, the annealing atmosphere is reductive to Fe, and thus the iron oxide is reduced. When the dew point of the annealing atmosphere is below −15° C., the above annealing atmosphere is still oxidative to element Al in steel substrate, and the Al in steel substrate forms a continuous dense $Al_2O_3$ film on the surface of the steel substrate, which affects the phosphorability. When the dew point of the annealing atmosphere is higher than 20° C., the oxygen potential in the annealing atmosphere is too high, the diffusion ability of O atoms into the steel substrate increases, and the internal oxidized layer formed with alloying elements such as Al and Mn on the surface of the steel sheet is too thick, which affects the forming properties of the surface of the steel sheet.

Preferably, the holding time in the step (5) is 30~200 s.

Preferably, in the present technical solution, in order to achieve a better implementation effect, the holding time of soaking is controlled to 30~200 s.

Further, in the method for manufacturing a cold-rolled low-density steel sheet according to the present invention, heating temperature in the step (2) is 1000~1250° C., holding time is 0.5~3 h and finishing rolling temperature is 800-900° C., and then the hot-rolled plate is coiled at 500~750° C.

In the method for manufacturing a cold-rolled low-density steel sheet having excellent phosphorability according to the present invention, the heating temperature in the step (2) is defined to 1000~1250° C. for the following reasons: when the heating temperature is higher than 1250° C., the slab of the steel sheet is over-fired and the grain structures in the slab are coarse, resulting in a decrease in hot workability, and the ultra-high temperature causes severe decarburization on the surface of the slab; when the heating temperature is lower than 1000° C., the finishing rolling temperature of the slab after high-pressure water descaling and initial rolling is too low, resulting in excessive deformation resistance of the slab, which makes it difficult to manufacture a steel sheet having a predetermined thickness and without surface defects.

In the method for manufacturing a cold-rolled low-density steel sheet having excellent phosphorability according to the present invention, the holding time in the step (2) is defined to 0.5~3 h for the following reasons: when the holding time exceeds 3 h, the grain structures in the slab of the steel sheet are coarse and the decarburization on the surface of the slab is serious; when the holding time is less than 0.5 h, the inside of the slab is not uniform.

In the method for manufacturing a cold-rolled low-density steel sheet having excellent phosphorability according to the present invention, the finishing rolling temperature in the step (2) is defined to 800~900° C. in order to complete the hot rolling of the casting slab. When the finishing rolling temperature is too low, the deformation resistance of the slab is too high, so that it is difficult to manufacture hot-rolled steel sheet and cold-rolled steel sheet having the required thickness and without surface and edge defects. Moreover, when the finishing rolling temperature in the present invention is lower than 800° C., the hot-rolled strip-shaped high-temperature ferrite inside the slab cannot sufficiently recover and cannot recrystallize and refine. Since the slab temperature naturally decreases during the hot rolling process after discharging the slab, it is difficult to control the finishing rolling temperature to be higher than 900° C.

In the method for manufacturing a cold-rolled low-density steel sheet having excellent phosphorability according to the present invention, in the step (2), it is defined to coil the hot-rolled plate at 500~750° C. When the coiling temperature is higher than 750° C., it is difficult to prevent the hot roll rolling strip from being flatly coiled, and the unevenness of the microstructures of the head, middle and tail materials of the hot-rolled coil increases; when the coiling temperature is lower than 500° C., the high tensile strength of the hot-rolled coil may cause difficulty in cold rolling.

Further, in the method for manufacturing a cold-rolled low-density steel sheet according to the present invention, the cold rolling reduction in the step (4) is 30~90%.

In the method for manufacturing a cold-rolled low-density steel sheet having excellent phosphorability according to the present invention, the cold rolling reduction in the step (4) is defined for the following reasons: the hot-rolled steel sheet after pickling is subjected to cold rolling deformation to obtain a predetermined thickness, a cold rolling reduction of more than 30% increases the austenite formation rate in the subsequent annealing process, contributes to the formation of deformed high-temperature ferrite and improves the microstructure uniformity of annealed steel sheet, thereby improving the ductility of the annealed steel sheet. However, when the cold rolling reduction is more than 90%, the deformation resistance of the material due to work hardening is very high, making it extremely difficult to prepare a cold-rolled steel sheet having a predetermined thickness and a good plate type. Therefore, the cold rolling reduction of the cold-rolled low-density steel sheet of the present invention is controlled to 30~90%.

Preferably, in the present technical solution, in order to achieve a better implementation effect, the cold rolling reduction is 50~80%.

Further, in the step (5) of the method for manufacturing a cold-rolled low-density steel sheet according to the present invention, the atmosphere of the heating section and the holding section is a mixed gas of $N_2$ and $H_2$, wherein the volume content of $H_2$ is 0.5~20%.

Preferably, in the present technical solution, in order to achieve a better implementation effect, the volume content of $H_2$ is 1~5%.

Preferably, in the present technical solution, in order to achieve a better implementation effect, the dew point of annealing atmosphere is controlled to −10~0° C.

Further, in the step (5) of the method for manufacturing a cold-rolled low-density steel sheet according to the present invention, the heating rate is 1~20° C./s, and the cooling rate after soaking is 1~150° C./s.

In the step (5) of the method for manufacturing a cold-rolled low-density steel sheet having excellent phosphorability according to the present invention, the cooling rate after soaking is 1~150° C./s, the cooling rate is preferably 10~50° C./s. The selection of the cooling rate needs to avoid the austenite decomposition of the steel sheet during cooling process.

The cold-rolled low-density steel sheet having excellent phosphorability of the present invention has the following advantages and beneficial effects:

(1) The cold-rolled low-density steel sheet according to the present invention has a low density (i.e. less than 7500 $kg/m^3$) due to a high content of Al element, thereby achieving weight reduction;

(2) The cold-rolled low-density steel sheet having excellent phosphorability according to the present invention has an iron particle layer and thus has excellent phosphorability;

(3) The cold-rolled low-density steel sheet having excellent phosphorability according to the present invention has excellent mechanical properties, and has an elongation of higher than 25% and a tensile strength of higher than 800 MPa.

DETAILED DESCRIPTION OF THE INVENTION

The cold-rolled low-density steel sheet having excellent phosphorability and manufacturing method therefor of the present invention will be further explained and illustrated with reference to Drawings and specific Examples. However, the explanation and illustration do not constitute undue limitations of the technical solutions of the present invention.

Figure 1:
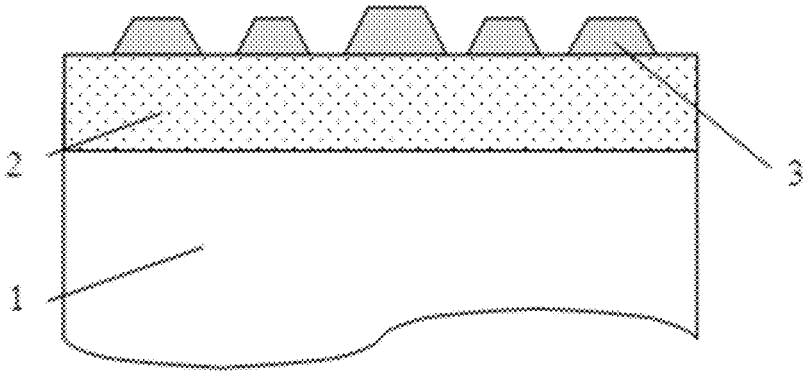
FIG. 1 is a schematic diagram showing the structure of the cold-rolled low-density steel sheet having excellent phosphorability of the present invention.

FIG. 1 shows the structure of the cold-rolled low-density steel sheet having excellent phosphorability of the present invention. As shown in FIG. 1, the cold-rolled low-density steel sheet having excellent phosphorability according to the present invention comprises a steel substrate 1, an iron particle layer 3 on the surface of the steel sheet, and an internal oxidized layer 2 in the inner layer of the iron particle layer which is adjacent to the iron particle layer.

Figure 2:
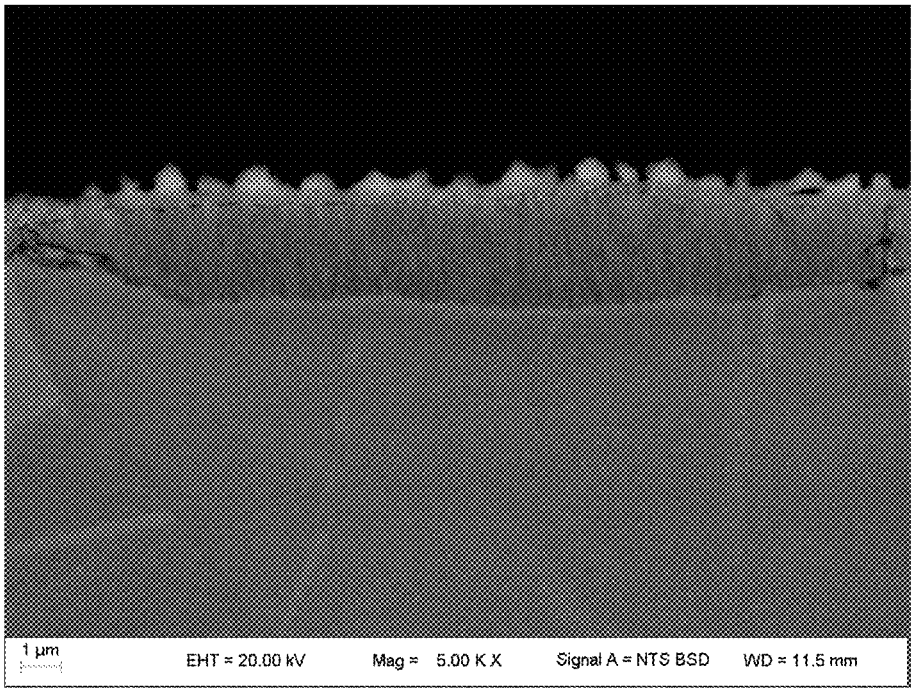
FIG. 2 shows the cross-sectional metallographic structure of the cold-rolled low-density steel sheet having excellent phosphorability of the present invention.

FIG. 2 shows the cross-sectional metallographic structure of the cold-rolled low-density steel sheet having excellent phosphorability of the present invention. As shown in FIG. 2, in the cold-rolled low-density steel sheet having excellent phosphorability of the present invention, the formation of external oxidation of iron particle layer 3 on the surface of $Al_2O_3$ is suppressed and converted into internal oxidation of the internal oxidized layer 2 by controlling the dew point of the annealing atmosphere, and iron particles are formed on the surface of the steel sheet. After phosphating, a surface having a uniform appearance and completely covered by the phosphating film is obtained. Wherein, the thickness of the internal oxidized layer 2 is 0.2~10 μm, oxides of the internal oxidized layer 2 exist in the grain boundary and inside the grain, the thickness of the iron particle layer 3 is less than the thickness of the internal oxidized layer, and the thickness of the iron particle layer 3 is 0.1~5 μm.

Examples A1-A16 and Comparative Examples B1-B6

Table 1 lists the mass percentages of the chemical elements in components of the cold-rolled low-density steel sheets having excellent phosphorability of Examples A1-A16 and the conventional steel sheets of Comparative Examples B1-B6.

TABLE 1

(wt %, the balance is Fe)

| | C | Mn | Al | Si | N | S | P |
|---|---|---|---|---|---|---|---|
| Component I | 0.37 | 1.1 | 4.1 | 0.31 | 0.0025 | 0.002 | 0.004 |
| Component II | 0.45 | 2 | 6.1 | — | 0.0040 | 0.003 | 0.007 |
| Component III | 0.34 | 2.8 | 5.2 | — | 0.0027 | 0.003 | 0.007 |

As can be seen from Table 1, the mass percentage ranges of chemical elements in components I, II, and III are controlled as follows: C: 0.25~0.50%, Mn: 0.25~4.0%, Al: 3.0~7.0%, P≤0.02%, S≤0.01%, N≤0.01%, and Si is added to the component I.

The cold-rolled low-density steel sheets having excellent phosphorability of Examples A1-A16 and the conventional steel sheets of Comparative Examples B1-B6 were prepared by the following steps:

(1) smelting and casting according to the mass percentage of the chemical elements of the corresponding components in Table 1;

(2) hot rolling, heating temperature is controlled to 1000~1250° C., holding time is 0.5~3 h and finishing rolling temperature is 800° C. or more, and then the hot-rolled plate is coiled at a temperature of lower than 750° C.;

(3) pickling;

(4) cold rolling, cold rolling reduction is controlled to 30~90%;

(5) continuous annealing: heating to a soaking temperature of 750-950° C. and then holding 30-600 s, then coiling the soaked strip steel after cooling, wherein the atmosphere of the heating section and the holding section is a mixed gas of $N_2$ and $H_2$, wherein the volume content of $H_2$ is 0.5~20%, dew point of annealing atmosphere is −15° C.~20° C., wherein the heating rate is 1~20° C./s, and the cooling rate after soaking is 1~150° C./s.

TABLE 2

| | | Step (2) | | | | Step (4) | Step (5) | | | | |
|---|---|---|---|---|---|---|---|---|---|---|---|
| | Step (1) Component | Heating temperature (° C.) | Holding time (h) | Finishing rolling temperature (° C.) | Coiling temperature (° C.) | Cold rolling reduction (%) | Soaking temperature (° C.) | Holding time of soaking (s) | Dew point of annealing atmosphere (° C.) | Volume content of $H_2$ (%) | Cooling rate (° C./s) |
| A1 | I | 1178 | 2.0 | 807 | 659 | 60 | 776 | 267 | −15 | 5 | 32 |
| A2 | I | 1178 | 2.0 | 807 | 659 | 60 | 815 | 356 | −10 | 5 | 35 |
| A3 | I | 1178 | 2.0 | 807 | 659 | 60 | 932 | 103 | −5 | 5 | 50 |
| A4 | I | 1178 | 2.0 | 807 | 659 | 60 | 837 | 135 | 0 | 5 | 32 |
| A5 | I | 1178 | 2.0 | 807 | 659 | 60 | 900 | 32 | 10 | 5 | 43 |
| A6 | I | 1178 | 2.0 | 807 | 659 | 60 | 833 | 129 | 20 | 10 | 38 |
| A7 | I | 1232 | 1.6 | 830 | 621 | 60 | 815 | 30 | −10 | 5 | 35 |
| A8 | I | 1232 | 1.6 | 830 | 621 | 60 | 792 | 289 | −10 | 2.5 | 25 |
| A9 | I | 1232 | 1.6 | 830 | 621 | 45 | 812 | 287 | −10 | 15 | 22 |
| A10 | I | 1161 | 1.7 | 817 | 729 | 45 | 867 | 189 | −10 | 11 | 68 |
| A11 | I | 1039 | 0.6 | 801 | 521 | 45 | 868 | 157 | −10 | 5 | 53 |
| A12 | I | 1150 | 0.5 | 898 | 647 | 45 | 817 | 221 | −5 | 5 | 52 |

TABLE 2-continued

| | Step (1) Component | Step (2) Heating temperature (° C.) | Step (2) Holding time (h) | Step (2) Finishing rolling temperature (° C.) | Step (2) Coiling temperature (° C.) | Step (4) Cold rolling reduction (%) | Step (5) Soaking temperature (° C.) | Step (5) Holding time of soaking (s) | Step (5) Dew point of annealing atmosphere (° C.) | Step (5) Volume content of $H_2$ (%) | Step (5) Cooling rate (° C./s) |
|---|---|---|---|---|---|---|---|---|---|---|---|
| A13 | II | 1116 | 1.8 | 854 | 516 | 60 | 790 | 281 | 0 | 3 | 23 |
| A14 | II | 1232 | 0.6 | 830 | 621 | 60 | 850 | 191 | −10 | 3 | 64 |
| A15 | III | 1208 | 0.8 | 828 | 656 | 60 | 814 | 40 | −10 | 3 | 62 |
| A16 | III | 1179 | 2.1 | 888 | 594 | 60 | 827 | 303 | −5 | 3 | 61 |
| B1 | I | 1178 | 2.0 | 807 | 659 | 60 | 837 | 135 | 40 | 5 | 52 |
| B2 | I | 1070 | 3.0 | 835 | 545 | 60 | 815 | 248 | −20 | 5 | 43 |
| B3 | I | 1246 | 1.4 | 830 | 663 | 60 | 700 | 72 | −10 | 5 | 88 |
| B4 | I | 1134 | 2.8 | 900 | 738 | 60 | 960 | 164 | −5 | 10 | 72 |
| B5 | II | 1145 | 1.6 | 817 | 547 | 60 | 913 | 215 | −40 | 5 | 31 |
| B6 | III | 1233 | 2.2 | 809 | 681 | 60 | 780 | 293 | −30 | 5 | 73 |

Table 2 lists the specific process parameters of the cold-rolled low-density steel sheets having excellent phosphorability of Examples A1-A16 and the conventional steel sheets of Comparative Examples B1-B6.

Figure 3:
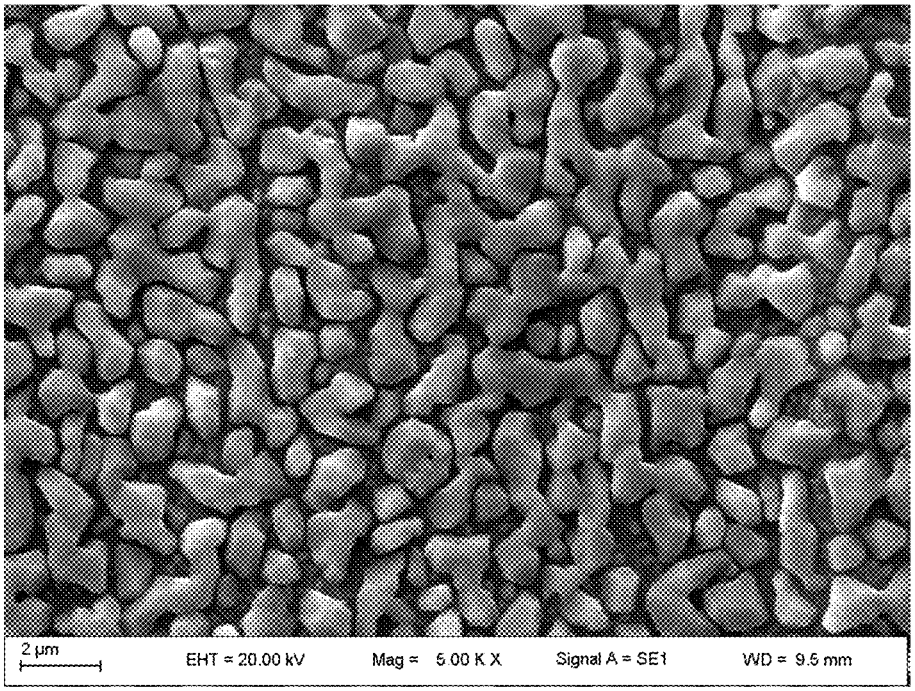
FIG. 3 is a secondary electron image of scanning electron microscope of the surface of Example A2 of the cold-rolled low-density steel sheet having excellent phosphorability according to the present invention.
Figure 4:
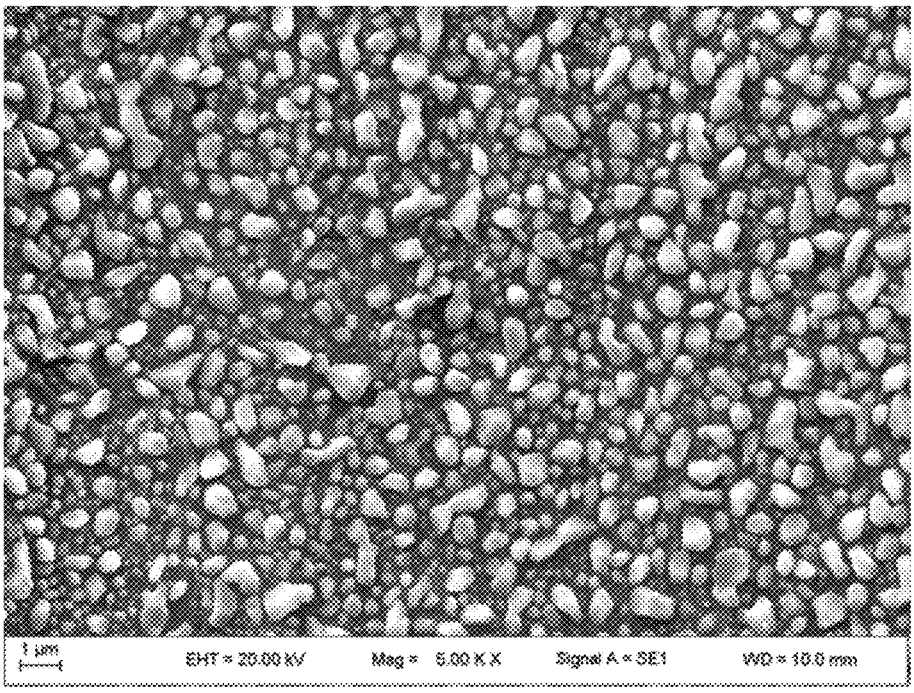
FIG. 4 is a secondary electron image of scanning electron microscope of the surface of Example A7 of the cold-rolled low-density steel sheet having excellent phosphorability according to the present invention.
Figure 5:
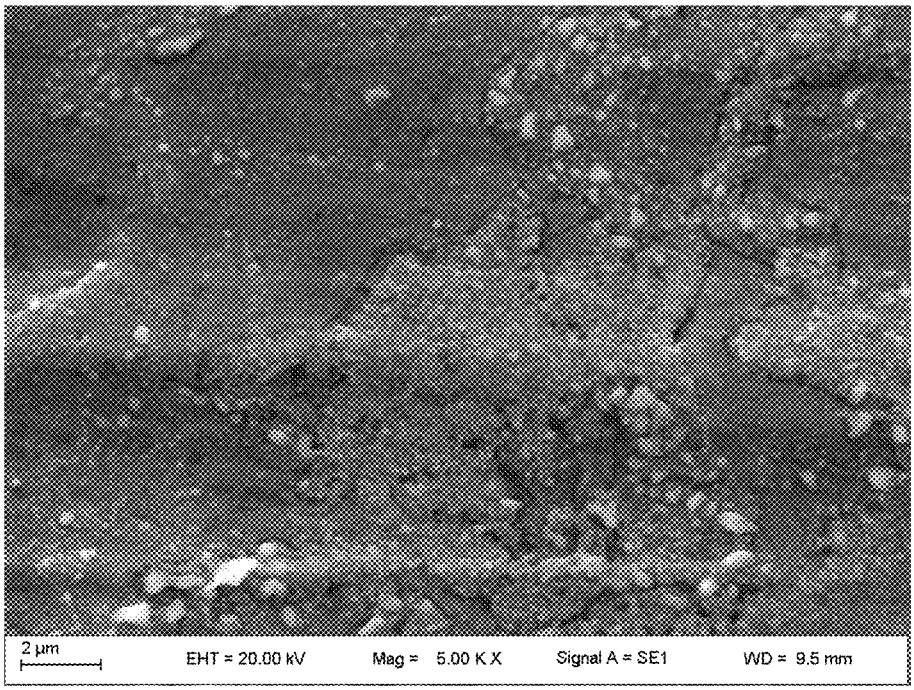
FIG. 5 is a secondary electron image of scanning electron microscope of the surface of Comparative Example B1 of the cold-rolled low-density steel sheet having excellent phosphorability according to the present invention.

FIG. 3 is a secondary electron image of scanning electron microscope of the surface of Example A2. FIG. 4 is a secondary electron image of scanning electron microscope of the surface of Example A7. FIG. 5 is a secondary electron image of scanning electron microscope of the surface of Comparative Example B1.

As shown in FIG. 3 and FIG. 4, iron particles appeared on the surfaces of Examples A2 and A7, except that the iron particles of Example A2 were sufficiently grown and the gap between the iron particles was small, while the iron particles of Example A7 were not sufficiently grown and the gap between the iron particles was large. As can be seen from Table 2, holding time of soaking in Example A2 is longer than holding time of soaking in Example A7. Therefore, holding time of soaking of the present invention is preferably 30~200 s. FIG. 5 is a secondary electron image of scanning electron microscope of the surface of Comparative Example B1, wherein a layer of $Al_2O_3$ film was observed on the surface, but no iron particles were observed, which surface morphological features are completely different from that of the Examples shown in FIGS. 3 and 4. It can be seen from the cross-section metallographic diagram that no iron particle layer or inner oxidized layer was formed in Comparative Example B1.

Table 3 lists the performance parameters of the cold-rolled low-density steel sheets having excellent phosphorability of Examples A1-A16 and the conventional steel sheets of Comparative Examples B1-B6.

Wherein, the phosphorability was determined by the following method: ten 500-fold fields of view on scanning electron microscope were randomly selected to observe the phosphating film on the surface of the steel sheet after phosphating, and the coverage fraction of the phosphating film was statistically analyzed by image software; if the average coverage fraction of ten fields of view of the phosphating film is 75% or more, the phosphorability is determined as good (indicated by ○), if the average coverage fraction of ten fields of view of the phosphating film is less than 75%, the phosphorability is determined as bad (indicated by X).

TABLE 3

| | Density ($kg/m^3$) | Elongation (%) | Tensile strength (MPa) | phosphorability |
|---|---|---|---|---|
| Example 1 | 7340 | 25 | 838 | ○ |
| Example 2 | 7340 | 32 | 831 | ○ |
| Example 3 | 7340 | 33 | 844 | ○ |
| Example 4 | 7340 | 25 | 823 | ○ |
| Example 5 | 7340 | 28 | 858 | ○ |
| Example 6 | 7340 | 34 | 852 | ○ |
| Example 7 | 7340 | 29 | 843 | ○ |
| Example 8 | 7340 | 33 | 828 | ○ |
| Example 9 | 7340 | 29 | 830 | ○ |
| Example 10 | 7340 | 27 | 851 | ○ |
| Example 11 | 7340 | 27 | 821 | ○ |
| Example 12 | 7340 | 26 | 848 | ○ |
| Example 13 | 7150 | 27 | 839 | ○ |
| Example 14 | 7150 | 28 | 850 | ○ |
| Example 15 | 7280 | 33 | 850 | ○ |
| Example 16 | 7280 | 26 | 836 | ○ |
| Comparative Example 1 | 7340 | 28 | 825 | X |
| Comparative Example 2 | 7340 | 27 | 851 | X |
| Comparative Example 3 | 7340 | 32 | 848 | X |
| Comparative Example 4 | 7340 | 35 | 849 | X |
| Comparative Example 5 | 7340 | 30 | 836 | X |
| Comparative Example 6 | 7280 | 27 | 836 | X |

As can be seen from Table 3, all of the Examples A1-A16 have a density of lower than 7500 $kg/m^3$, a elongation of higher than 25% and a tensile strength of higher than 800 MPa, and the phosphorability of Examples A1-A16 are superior to that of Comparative Examples B1-B6.

Figure 6:
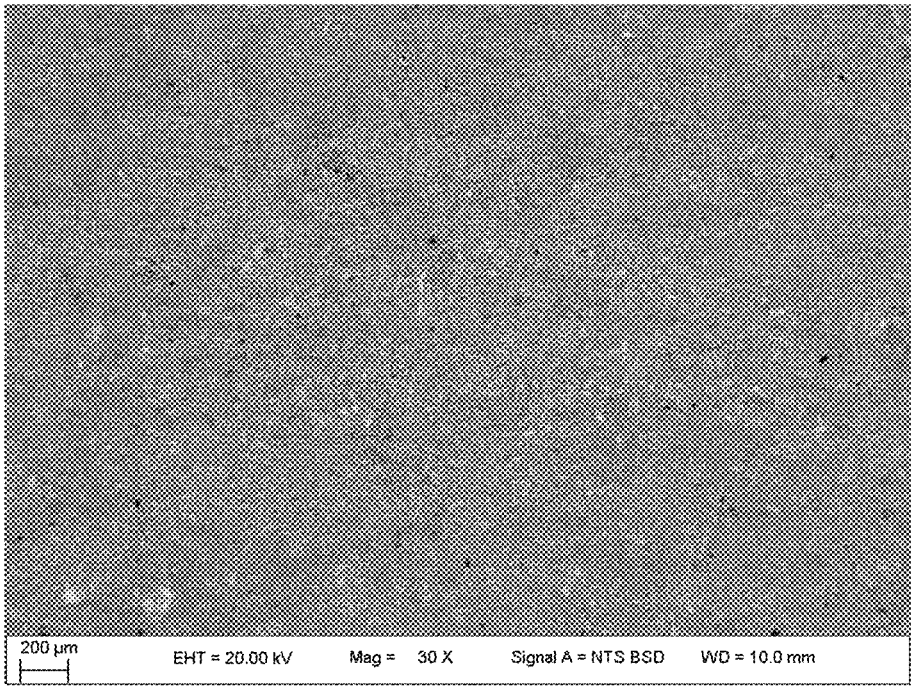
FIG. 6 is a low-magnification backscattered electron image of scanning electron microscope of the surface of Example A2 of the cold-rolled low-density steel sheet having excellent phosphorability according to the present invention after phosphating.
Figure 7:
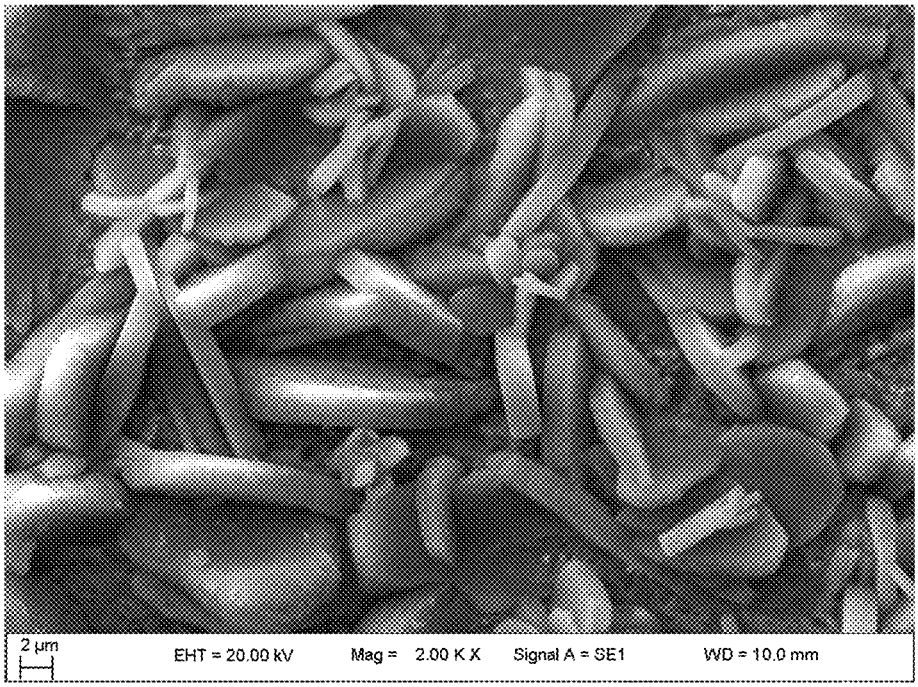
FIG. 7 is a high-magnification secondary electron image of scanning electron microscope of the surface of Example A2 of the cold-rolled low-density steel sheet having excellent phosphorability according to the present invention after phosphating.
Figure 8:
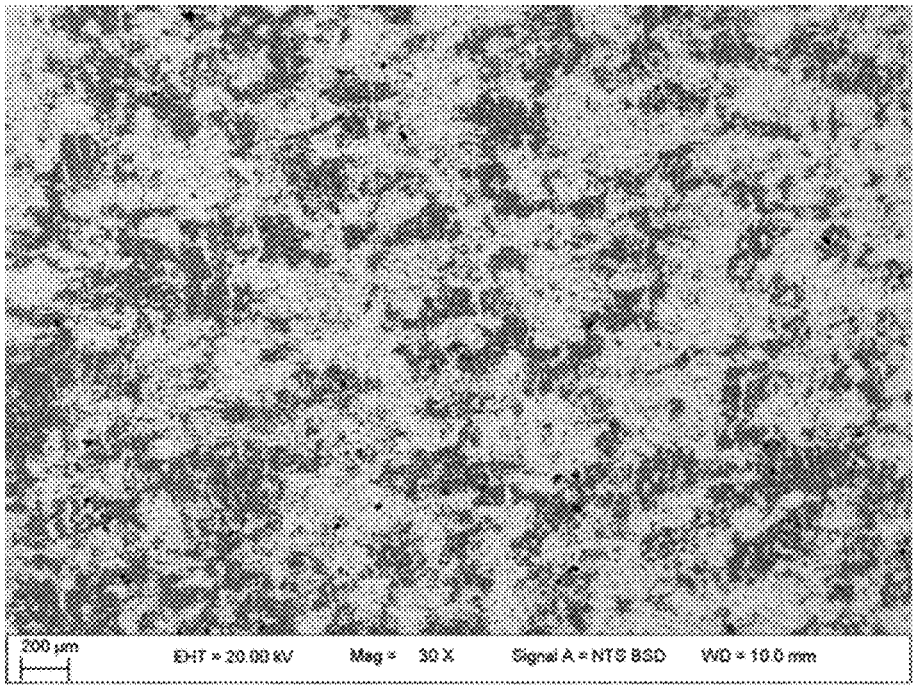
FIG. 8 is a low-magnification backscattered electron image of scanning electron microscope of the surface of Comparative Example B1 of the cold-rolled low-density steel sheet having excellent phosphorability according to the present invention after phosphating.
Figure 9:
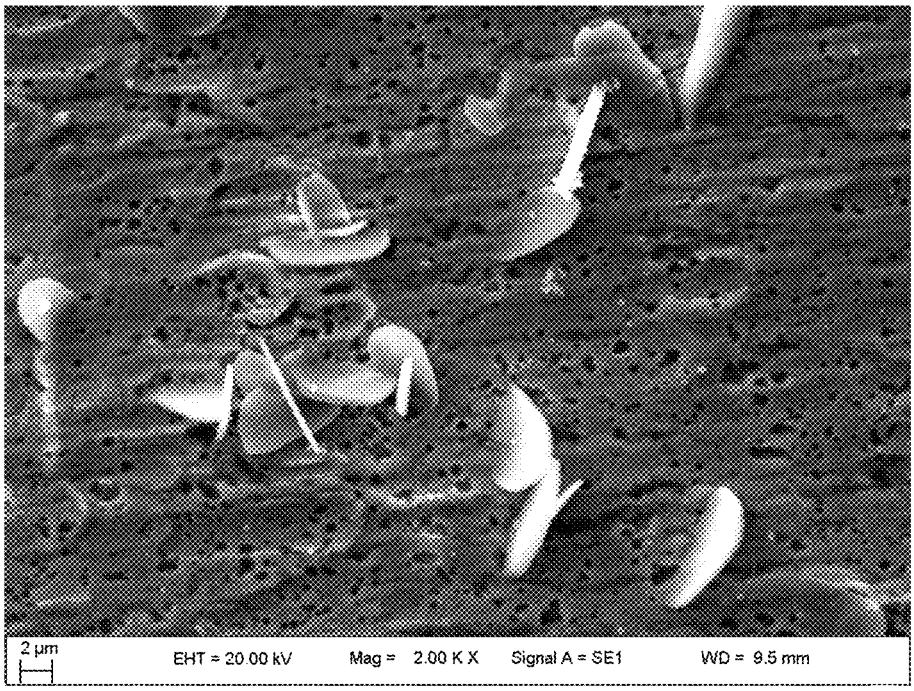
FIG. 9 is a high-magnification secondary electron image of scanning electron microscope of the surface of Comparative Example B1 of the cold-rolled low-density steel sheet having excellent phosphorability according to the present invention after phosphating.

FIG. 6 is a low-magnification backscattered electron image of scanning electron microscope of the surface of Example A2 of the cold-rolled low-density steel sheet having excellent phosphorability according to the present invention after phosphating. FIG. 7 is a high-magnification secondary electron image of scanning electron microscope of the surface of Example A2 of the cold-rolled low-density steel sheet having excellent phosphorability according to the present invention after phosphating. FIG. 8 is a low-magnification backscattered electron image of scanning electron microscope of the surface of Comparative Example B1 of the cold-rolled low-density steel sheet having excellent phosphorability according to the present invention after phosphating. FIG. 9 is a high-magnification secondary electron image of scanning electron microscope of the surface of Comparative Example B1 of the cold-rolled low-density steel sheet having excellent phosphorability according to the present invention after phosphating.

As shown in FIG. 6, uniform phosphating of Example A2 was observed at a low magnification of scanning electron microscope. Further, as can be seen from the high-magnification observation shown in FIG. 7, the phosphating film of Example A2 completely covers the surface of the steel sheet and the phosphating crystal is uniform. As can be seen from the low-magnification of scanning electron microscope shown in FIG. 8, the phosphating in Comparative Example B1 is non-uniform, wherein the black region is a region where phosphating crystals are formed and the white region is a region where no phosphating crystals are formed, and the surface phosphating coverage fraction is low. A further magnified image is shown in FIG. 9. As can be seen from FIG. 9, only a part of the surface of Comparative Example B1 has phosphating crystals.

The reasons are as follows: the dew points of the annealing atmosphere of the Examples are −15° C. to +20° C. In the above dew point range, element Al can be converted from external oxidation to internal oxidation, thereby avoiding the formation of a continuous dense $Al_2O_3$ film on the surface of the steel sheet of the Example to affect the phosphating, and so that element Al forms a thickness of 0.2~10 μm in the oxidized layer of the steel sheet. Since the surface layer of the steel sheet of the Examples has an iron particle layer, when phosphating the steel sheet of the Examples, it is equivalent to phosphating the surface of normal mild steel. On the contrary, in the Comparative Examples, since the surface of steel substrate does not form an effective iron particle layer but a continuous dense $Al_2O_3$ oxide film, which hinders the reaction of phosphating solution with iron, and thus no effective phosphating film is formed.

It is to be noted that the above description is only specific Examples of the present invention, and it is obvious that the present invention has many similar modifications and is not limited to the above Examples. All modifications derived or conceived by those skilled in the art from the disclosure of the present invention should fall within the scope of the present invention.

The invention claimed is:

1. A cold-rolled low-density steel sheet comprising: disposed iron particles that are disposed on a surface of the cold-rolled low-density steel sheet forming an iron particle layer, wherein the cold-rolled low-density steel sheet contains 3.0% to 7.0% of element Al by mass percentage, and the cold-rolled low-density steel sheet has a density of less than 7500 kg/m$^3$.

2. The cold-rolled low-density steel sheet according to claim 1, wherein, an inner side of the iron particle layer has an internal oxidized layer adjacent to the iron particle layer, and the internal oxidized layer contains oxides of Al.

3. The cold-rolled low-density steel sheet according to claim 2, wherein, the internal oxidized layer further contains oxides of Mn.

4. The cold-rolled low-density steel sheet according to claim 2, wherein, the internal oxidized layer has a thickness of 0.2-10 μm.

5. The cold-rolled low-density steel sheet according to claim 2, wherein, the oxides of the internal oxidized layer exist in a grain boundary and inside a grain.

6. The cold-rolled low-density steel sheet according to claim 2, wherein, the thickness of the iron particle layer is less than the thickness of the internal oxidized layer.

7. The cold-rolled low-density steel sheet according to claim 1, wherein, the iron particle layer has a thickness of 0.1-5 μm.

8. The cold-rolled low-density steel sheet according to claim 1, wherein, the disposed iron particles have a particle size of 0.1-5 μm.

9. The cold-rolled low-density steel sheet according to claim 1, wherein, the disposed iron particles cover 30% or more of the surface area of the steel sheet.

10. The cold-rolled low-density steel sheet according to claim 1, wherein, maximum space between adjacent disposed iron particles is no more than 10 times the average particle size of the disposed iron particles.

11. The cold-rolled low-density steel sheet according to claim 1, wherein, microstructures of the steel sheet are ferrite and residual austenite.

12. The cold-roiled low-density steel sheet according to claim 11, wherein, a phase ratio of the residual austenite is 6-30%.

13. The cold-rolled low-density steel sheet according to claim 11, wherein, a mass percentage of element C in the residual austenite is not less than 0.8%.

14. The cold-rolled low-density steel sheet according to claim 1, wherein, the cold-rolled low-density steel sheet has a mass percentages of chemical elements as follows: C: 0.25-0.50%, Mn: 0.25-4.0% Al: 3.0-7.0%, and the balance being Fe and unavoidable impurities.

15. The cold-rolled low-density steel sheet according to claim 14, wherein, the cold-rolled low-density steel sheet has an elongation of higher than 25%, and a tensile strength of higher than 800 MPa.

16. A method for manufacturing the cold-rolled low-density steel sheet according to claim 1, comprising steps of: (1) smelting and casting; (2) hot rolling; (3) pickling; (4) cold rolling; (5) continuous annealing: heating to a soaking temperature of 750-950° C. and then holding for 30-600 s, wherein a dew point of an annealing atmosphere is −15° C.-20° C.; then coiling a soaked strip steel after cooling.

17. The method for manufacturing the cold-roiled low-density steel sheet according to claim 16, wherein, in the step (2), a heating temperature is 1000-1250° C., a holding time is 0.5-3 h and a finishing rolling temperature is 800-900° C. to form a hot rolled plate, and then the hot-rolled plate is coiled at 500-750° C.

18. The method for manufacturing the cold-roiled low-density steel sheet according to claim 16, wherein, a cold rolling reduction in the step (4) is 30-90%.

19. The method for manufacturing the cold-rolled low-density steel sheet according to claim 16, wherein, in the step (5), an atmosphere of a heating section and a holding section is a mixed gas of $N_2$ and $H_2$, wherein a volume content of $H_2$ is 0.5-20%.

20. The method for manufacturing the cold-rolled low-density steel sheet according to claim 16, wherein, in the step (5), a heating rate is 1-20° C./s and a cooling rate after soaking is 1-150° C.

* * * * *